US010132090B2

(12) United States Patent
Ceysson et al.

(10) Patent No.: US 10,132,090 B2
(45) Date of Patent: Nov. 20, 2018

(54) DEVICE FOR LAYERING FLOOR AND WALL COVERINGS FOR OUTSIDE CORNERS

(71) Applicant: GERFLOR, Villeurbanne (FR)

(72) Inventors: Olivier Ceysson, Bollene (FR); Pascal Paganini, Tarare (FR)

(73) Assignee: GERFLOR, Villeurbanne (FR)

( * ) Notice: Subject to any disclaimer, the term of this patent is extended or adjusted under 35 U.S.C. 154(b) by 0 days.

(21) Appl. No.: 15/323,875

(22) PCT Filed: Jul. 7, 2015

(86) PCT No.: PCT/FR2015/051875

§ 371 (c)(1),
(2) Date: Jan. 4, 2017

(87) PCT Pub. No.: WO2016/005695

PCT Pub. Date: Jan. 14, 2016

(65) Prior Publication Data

US 2017/0145702 A1 May 25, 2017

(30) Foreign Application Priority Data

Jul. 7, 2014 (FR) ..... 14 56542

(51) Int. Cl.
*E04F 19/04* (2006.01)
*E04F 21/22* (2006.01)
(Continued)

(52) U.S. Cl.
CPC ..... *E04F 21/22* (2013.01); *E04F 13/0733* (2013.01); *E04F 19/04* (2013.01);
(Continued)

(58) Field of Classification Search
CPC ... E04F 13/0733; E04F 19/04; E04F 19/0486; E04F 19/064; E04F 19/061;
(Continued)

(56) References Cited

U.S. PATENT DOCUMENTS 2,069,289 A * 2/1937 Swendsen ..... E04F 19/04 52/288.1
4,330,581 A * 5/1982 Borgert ..... E04D 13/1407 428/174
(Continued)

FOREIGN PATENT DOCUMENTS

DE 487557 C 12/1929
EP 2527562 A1 11/2012
(Continued)

OTHER PUBLICATIONS

International Search Report and Written Opinion issued in PCT/FR2015/051875 dated Oct. 21, 2015.

*Primary Examiner* — Christine T Cajilig
(74) *Attorney, Agent, or Firm* — Marshall, Gerstein & Borun LLP

(57) ABSTRACT

A device for laying floor and wall covering for outside corners includes two portions, namely a rigid "central" first portion that is substantially in the shape of a hollow tetrahedron or of a quarter of a truncated cone, and a flexible "peripheral" second portion that is substantially triangular in shape and that extends from the periphery of the central portion. The peripheral portion comes to bear against the floor portion and against the wall portions that are disposed facing the device.

8 Claims, 4 Drawing Sheets

(51) Int. Cl.
*E04F 13/073* (2006.01)
*E04F 21/18* (2006.01)

(52) U.S. Cl.
CPC ..... *E04F 19/0486* (2013.01); *E04F 19/0495* (2013.01); *E04F 21/18* (2013.01); *E04F 2019/0422* (2013.01); *E04F 2019/0431* (2013.01); *E04F 2203/06* (2013.01); *E04F 2290/00* (2013.01)

(58) Field of Classification Search
CPC ..... E04F 2019/0422; E04F 2203/023; E04F 19/0495; E04F 2019/0431
See application file for complete search history.

(56) References Cited

U.S. PATENT DOCUMENTS 4,603,517 A * 8/1986 Lyons, Jr. ..... E04D 13/1407 52/219
4,872,296 A * 10/1989 Janni ..... B29C 65/02 52/287.1
6,216,407 B1 * 4/2001 LeBlanc ..... E04F 19/0436 52/287.1
8,572,915 B2 * 11/2013 Meahl ..... E04F 19/04 52/287.1
2003/0038054 A1 * 2/2003 Hurley ..... B65D 81/056 206/586
2006/0277777 A1 * 12/2006 Mossot ..... E04F 19/045 33/527
2008/0172963 A1 * 7/2008 Harrison ..... E04F 19/022 52/287.1
2011/0162305 A1 * 7/2011 Bullis ..... E04F 19/028 52/287.1
2012/0085048 A1 * 4/2012 Higgins ..... E04F 19/0495 52/287.1
2013/0047533 A1 * 2/2013 Diener ..... E04F 19/0486 52/288.1
2014/0093689 A1 * 4/2014 Amundson ..... E04F 19/064 428/156
2017/0145702 A1 † 5/2017 Ceysson et al.

FOREIGN PATENT DOCUMENTS

GB 136897 A * 12/1919 ..... E04F 19/0495
GB 1023190 A 3/1966
GB 4031439 † 8/2013
WO WO-2012/123671 A1 9/2012
WO WO 2012123671 A1 * 9/2012 ..... E04F 19/045
WO DM/085 148 † 12/2014

* cited by examiner
† cited by third party

DEVICE FOR LAYERING FLOOR AND WALL COVERINGS FOR OUTSIDE CORNERS

TECHNICAL FIELD

The present disclosure relates to the technical field of covering floors and walls with polyvinyl chloride materials or the like, and it relates more particularly to a device for laying floor and wall coverings for outside corners.

BACKGROUND

In the field of floor coverings or "floorings", various methods are well known for laying floor and wall coverings at outside corner portions. However, those laying methods suffer from certain problems and drawbacks.

With reference to FIGS. 1 to 3, a usually used first laying method implements the following steps. Along the join line, between the floor (1C) and the walls (1A, 1B), a cradle (1) is placed that is a shaped section member of quarter-circle section and that is fastened by adhesive bonding or the like, via its longitudinal end portions, to the facing faces of the floor surface (1C) and of the wall surfaces (1A, 1B). Then the floor covering (R) is brought to the corner portion while turning it up against the corresponding vertical surfaces (1A, 1B) of the walls. To achieve that, it is necessary first to make a V-shaped cut (2) in the covering (R), with the tip of the V-shape corresponding to the low point of the angle between the two walls (1A, 1B). A separate V-shaped piece (3) is then laid over the outside corner and welded to the floor covering (R) at the V-shaped cut (2). The separate piece (3) is welded in two stages, which increases the laying time. That hot welding, with a welding bead (4) being deposited, starts from the low outside corner point and is performed along the two slanting lines of the V-shape. The corner (1D) being formed in two successive vertical planes (1A, 1B) can give rise to a drum-skin effect and to a risk of tearing if the welding is not performed properly.

One of the difficulties encountered remains controlling the quality of the welding, since such quality control can be visual only. In practice, it has been observed that it suffices for there to be a tiny incipient fracture for sealing not to be guaranteed.

Another problem lies in the fact that the welding operation at corners, using a wheel or a nozzle, can damage the covering (R) at the corner, e.g. by causing burns on the covering (R) with deformations, such as swellings or the like, making it look dirty and not very neat.

In addition, such outside corners have sharp edges that are not good at withstanding impacts with cleaning equipment, such impacts regularly causing the covering to tear and ultimately causing sealing to be lost.

In addition, on heterogeneous floorings with fiberglass mesh or scrim, it is necessary to chip away or notch the mesh on the back of the V-shaped separate piece (3) of covering so that it fits over the edge of the outside corner. In addition to the fact that that step increases the laying time, it can also cause the mesh to break as the separate piece (3) is being folded.

With reference to FIGS. 4 and 5, another solution for skirting turn-ups consists in forming strips that are folded at 90° and that extend outwards over a width of about 10 cm on the floor (1C), and then in welding the strip as laid flat to the flooring. For outside corners, a shell (5) is previously formed from a strip of floor covering by folding it, and then said shell (5) is sealed on its back with appropriate resin.

Said shell (5) is then welded to the flooring and to the two strips extending on either side of the outside corner.

This type of laying at outside corners suffers from the drawback of requiring a large number of welds, which increase the laying time. In addition, it requires a shell (5) to be made first, such a shell generally being formed at the worksite, and therefore also increasing the laying time. Furthermore, such an outside corner has sharp edges that are not good at withstanding impacts with cleaning equipment, such impacts regularly causing the covering to tear and sealing to be lost.

SUMMARY OF THE DISCLOSURE

An object of the disclosed embodiments is thus to remedy all of those drawbacks by proposing a device for laying floor and wall coverings for outside corners that is of simple and inexpensive design, that is easy to use for laying operatives who do not have specific expertise, without using tools necessary for transforming the device from one state to another, and also while accommodating the imperfections that are inherent to wall surface states and also accommodating variations in the relative angular position of the two consecutive surfaces of a wall receiving the device for laying floor and wall covering at an outside corner.

To this end, the described embodiments provide a device for laying floor and wall covering for outside corners, the device being remarkable in that it comprises two portions, namely a rigid "central" first portion that is substantially in the shape of a hollow tetrahedron or of a quarter of a truncated cone, and a flexible "peripheral" second portion that is substantially triangular in shape and that extends from the periphery of the central portion (6), said peripheral portion coming to bear against the floor portion and against the wall portions that are disposed facing said device.

It can be well understood that the device is quick and easy to fit, unlike the prior art devices, and that by means of the flexibility and softness of its peripheral portion, the edges of said peripheral portion bear fully against the wall and floor surfaces, regardless of the defects in said surfaces.

In a first variant embodiment, the central portion is in the shape of an isosceles tetrahedron.

In a second variant embodiment, the central portion is in the shape of a quarter of a truncated cone that has its base flaring outwards.

Preferably, the two vertices of the base of the peripheral portion are rounded.

In addition, the peripheral portion consists of a zone of flexible material bonded with the rigid synthetic material of which the rigid central portion is made.

In a variant embodiment, the peripheral portion consists of a zone in which the density of the material is less than the density of the material of the rigid central portion, the central portion and the peripheral portion being made of the same material or of different materials.

Preferably, the central portion and the peripheral portion are made of polyvinyl chloride (PVC).

BRIEF DESCRIPTION OF THE DRAWINGS

Other advantages and characteristics appear more clearly from the following description of a single embodiment of the device for laying floor and wall coverings for outside corners, given by way of non-limiting example and with reference to the accompanying drawings, in which.

DETAILED DESCRIPTION

For reasons of clarity, in the description below, like elements in the various figures are designated by like references. Furthermore, the various views are not necessarily drawn to scale.

Figure 1:
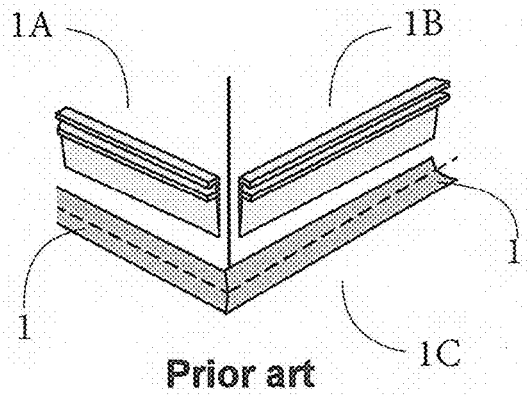
FIGS. 1 to 3 are diagrammatic perspective views showing the various steps of a first prior art method of laying covering portions at an outside angle.
Figure 2:
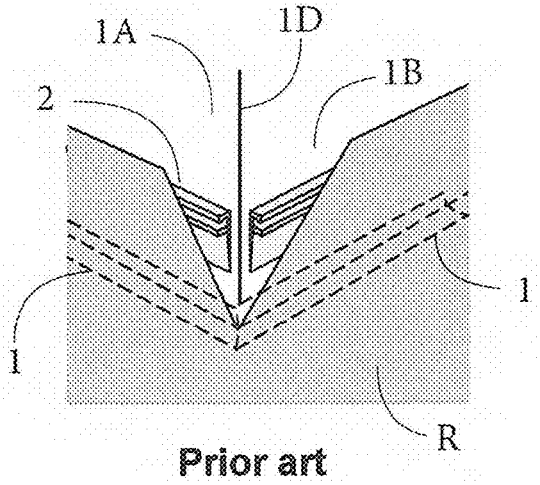
Figure 3:
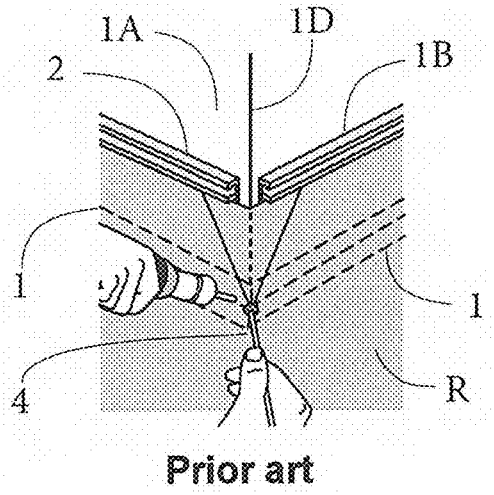
Figure 4:
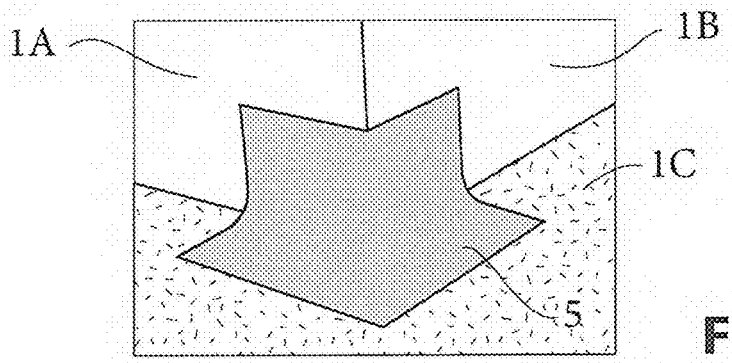
Fig. 4 Prior art
FIGS. 4 and 5 are diagrammatic perspective views showing the various steps of a second prior art method of laying covering portions at an outside angle.
Figure 5:
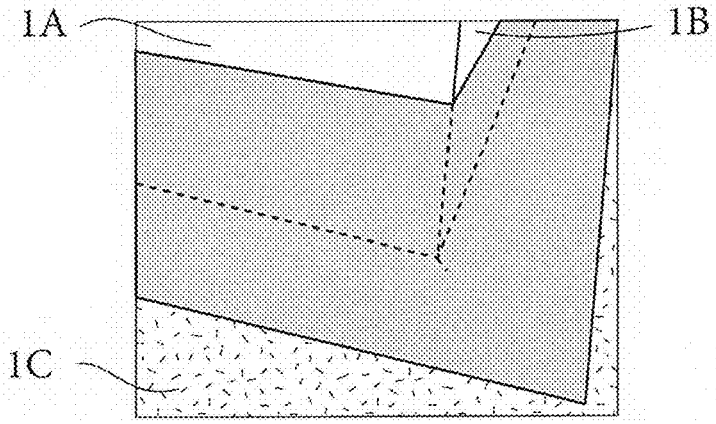
Fig. 5 Prior art
Figure 6:
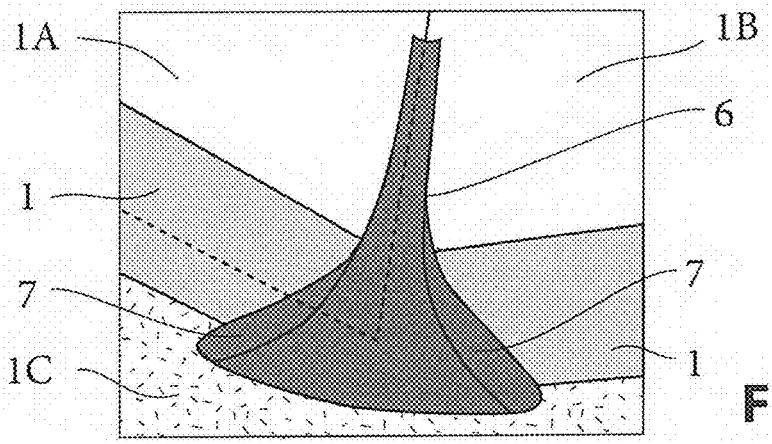
FIG. 6 is a perspective view of the device for laying floor and wall covering for outside corners, said device being designed to be pre-positioned on said outside corner portion.

With reference to FIG. 6, the device for laying floor and wall covering for outside corners comprises two portions, namely a rigid "central" first portion (6) that is substantially in the shape of a hollow quarter of a truncated cone, and a flexible "peripheral" second portion (7) that is substantially triangular in shape and that extends along the two vertical edges of the central portion (6), said peripheral portion (7) coming to bear against the floor portion and against the wall portions that are disposed facing said device as is described in detail below.

Said central portion (6) consists of a rigid and hollow piece that is in the shape of a quarter of a truncated cone. Said peripheral portion (7) consists of two flexible, i.e. soft, pieces that are substantially triangular in shape and in each of which the two vertices of the base are rounded and the vertex opposite from the base extends in the vicinity of the top end of the central portion (6), the top end of the central portion (6) corresponding to the small base of the truncated cone. Furthermore, the quarter of a truncated cone shape of the central portion (6) is preferably flared going outwards, i.e. the surface of the central portion (6) is concave, with its concave side facing outwards. In similar manner, the soft peripheral portion (7) is preferably concave, with the concave side facing outwards, i.e. facing away from the walls when the device is put in place on a corner.

In addition, said peripheral portion (7) consists of a zone of flexible material bonded with the rigid synthetic material of which the rigid central portion (6) is made. The rigid synthetic material of which the central portion (6) is made consists, for example, of rigid polyvinyl chloride (PVC) that is well known to the person skilled in the art, and the peripheral portion (7) is obtained by adding one or more plasticizers that are well known to the person skilled in the art to the PVC in order to obtain flexible PVC. Furthermore, other polymers with such rigidity or flexibility characteristics may perform the same functions for the central portion (6) or for the peripheral portion (7).

Alternatively, the peripheral portion (7) may consist of a zone in which the density of the material is less than the density of the material of the rigid central portion (6), the central portion (6) and the peripheral portion (7) being made of the same material, namely polyvinyl chloride (PVC) or some other polymer.

In another variant embodiment, the flexible peripheral portion (7) is obtained by overmolding, i.e. by being molded over the rigid central portion (6). The chemical nature of the central portion (6) and the chemical nature of the peripheral portion (7) are obtained with the same material or with different materials.

The device for laying floor and wall coverings for outside corners is referenced overall by (D). It is designed to be positioned in an angle portion between a wall surface (M) and a floor surface (S). Edgings (1) that are known per se, and that are, for example, obtained by molding, are placed in the angle portions between the floor and the wall(s) in the zones of length of the room to be covered with said covering (R).

In ancillary manner, the bottom edge of the rigid central portion (6) may have a bulge, the lower edge of the skirting bearing against the end-wall of the hollow formed by the bulge, thereby guaranteeing excellent sealing.

Figure 9:
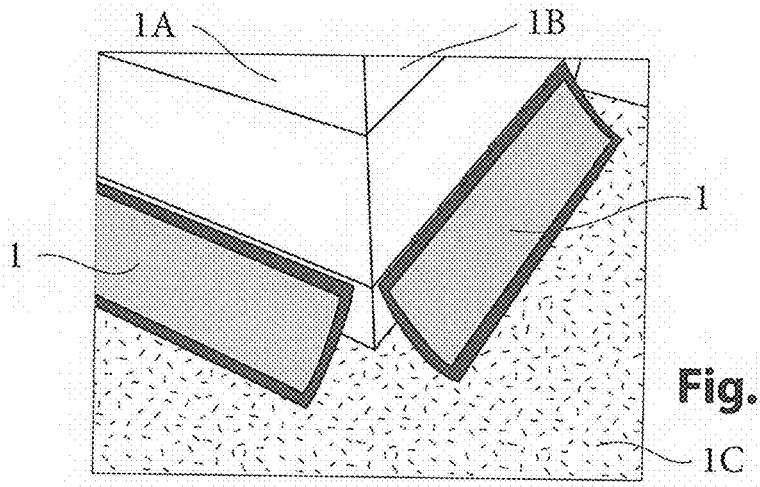
FIGS. 9 to 11 are perspective views showing the various steps of laying using the variant embodiment of the device.
Figure 10:
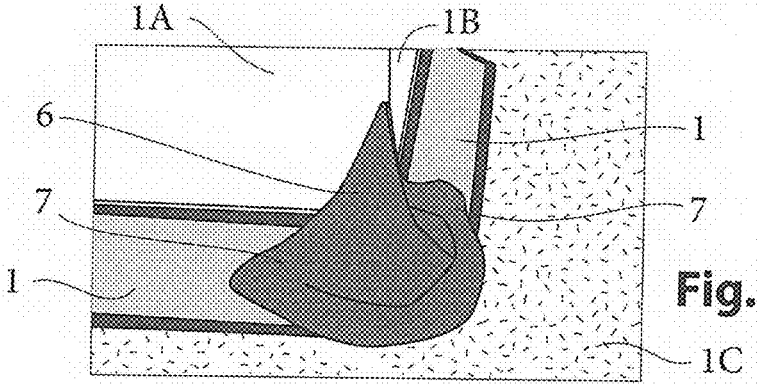
Figure 11:
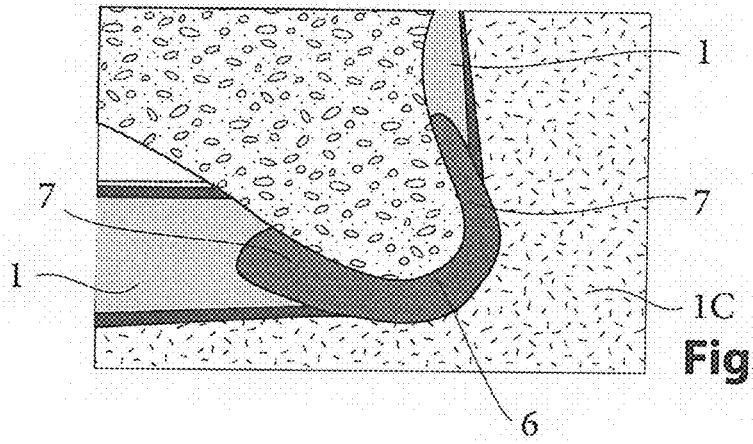

With reference to FIGS. 9 to 11, an explanation is given below of how the device for laying floor and wall covering for outside corners operates.

Firstly, edgings (1) that are known per se, and that are, for example, obtained by molding, are placed in the angle portions between the floor and the wall(s) in the zones of length of the room to be covered with said covering. Then the device is positioned in register with the outside corner in such a manner that the edge of the base of the peripheral portion (7) bears against the floor and the wall portions (1A, 1B), the top of the rigid central portion (6) bears against the edge (M) of the wall surface, and the bottom portion of the central portion (6) bears against the floor (1C). The operative can then lay the floor covering while causing it to overlie the edgings and the device.

It can be observed that the advantages such as the simplicity of the device and the quickness and ease with which it can be fitted appear from the description. More particularly, it should be noted that, through its flexibility and softness, the edges of the peripheral portion (7) bear fully against the wall surfaces and floor surface, regardless of the defects in those surfaces. It should also be noted that the device makes it possible for it to be fitted quickly regardless of its size and without requiring a jig or specific fitting tools. In addition, the welding is performed in a single step without any joins because it is performed at the lower portion of the rigid central portion (6). Furthermore, in addition to the fact that sealing is guaranteed due to the welding not being performed at the level of the floor, the rounded shape of the device does not give rise to any drum-skin effect and enables the floorings to be cleaned easily using industrial or manual equipment.

Figure 7:
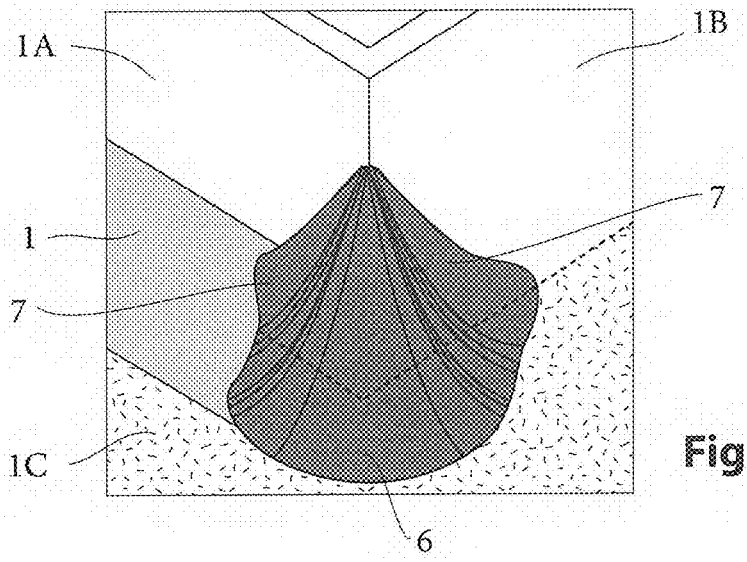
FIG. 7 is a perspective view of a variant embodiment of the device for laying floor and wall covering for outside corners.
Figure 8:
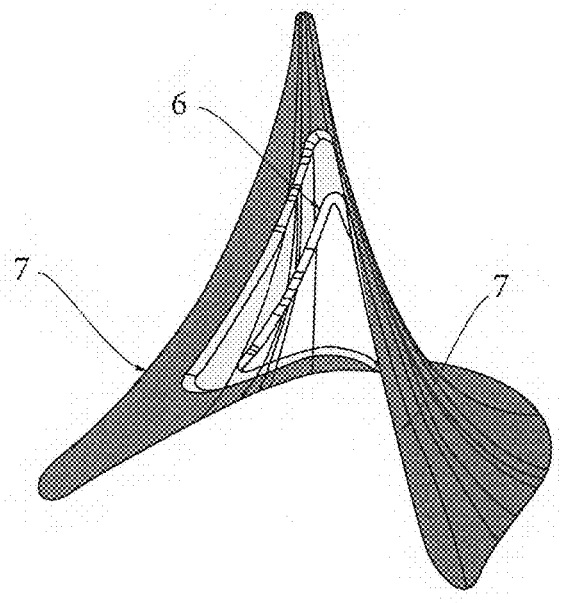
FIG. 8 is a perspective rear cutaway view of the variant embodiment of the device for laying floor and wall covering for outside corners.

With reference to FIGS. 7 and 8, in a variant embodiment of the device, and in the same manner as above, the device is made up of two portions, namely a rigid "central" first portion (6) and a flexible "peripheral" second portion (7) that has a substantially triangular shape and that extends along the two vertical edges of the central portion (6), said peripheral portion (7) coming to bear on the floor portion and on the wall portions disposed facing said device, as explained in detail below.

This variant embodiment differs from the above-described variant embodiment by the fact that said central portion (6) consists of a rigid and hollow piece that is in the shape of a tetrahedron. Said peripheral portion (7) consists of two flexible, i.e. soft, pieces that are substantially triangular in shape and in each of which the two vertices of the base are rounded and the vertex opposite from the base extends in the vicinity of the top end of the central portion (6), the top end of the central portion (6) corresponding to one of the vertices of the tetrahedron. In addition, the surfaces of the central portion (6) are preferably concave, with the concave side facing outwards. In similar manner, the soft peripheral portion (7) is preferably concave, with the concave side facing outwards, i.e. facing away from the walls when the device is put in place on a corner.

With reference to FIG. 8, in this particular variant embodiment, the central portion (6) is made of a polymer, e.g. of polyvinyl chloride (PVC), and has a plurality of thicknesses so as to make said central portion rigid, and the peripheral portion (7) is also made of the same polymer, with a thickness significantly smaller than the thickness of the central portion (6), in such a manner that the peripheral portion (7) is soft.

In the same way as described above, said peripheral portion (7) may consist of a zone of flexible material bonded with the rigid synthetic material of which the rigid central portion (6) is made. The rigid synthetic material of which the central portion (6) is made consists, for example, of rigid polyvinyl chloride (PVC) that is well known to the person skilled in the art, and the peripheral portion (7) is obtained by adding one or more plasticizers that are well known to the person skilled in the art to the PVC in order to obtain flexible PVC.

Alternatively, the peripheral portion (7) may either consist of a zone in which the density of the material is less than the density of the material of the rigid central portion (6), the central portion (6) and the peripheral portion (7) being made of the same material, namely polyvinyl chloride (PVC), or else be obtained by overmolding, i.e. by being molded over the rigid central portion (6), the chemical nature of the central portion (6) and the chemical nature of the peripheral portion (7) being obtained with the same material or with different materials, or else by varying the thickness of an appropriate flexible material so as to impart more rigidity to the central portion (6) than to the peripheral portion (7).

Finally, naturally the above-given examples are merely particular illustrations that in no way limit the fields of application of the described embodiments.

The invention claimed is:

1. A device for laying floor and wall covering for outside corners, the device comprising:

a single piece ready to be used directly, regardless of its size and without requiring a jig or specific fitting tools, and without using tools necessary for transforming the device from one state to another, the single piece consisting of a rigid central first portion and a flexible peripheral second portion overmolded on the central first portion, the central first portion substantially in the shape of a hollow tetrahedron or of a quarter of a truncated cone, and the peripheral second portion substantially triangular in shape and extending from the whole periphery of the central first portion, wherein a vertex of the peripheral second portion opposite from a base extends in a vicinity of a top end of the central first portion, such that the peripheral second portion is configured to bear against a floor portion and against wall portions that are disposed facing the device.

2. A device according to claim 1, wherein the central first portion is in the shape of an isosceles tetrahedron.

3. A device according to claim 1, wherein the central first portion is in the shape of a quarter of a truncated cone that has its base flaring outwards.

4. A device according to claim 1, wherein two vertices of a base of the peripheral second portion are rounded.

5. A device according to claim 1, wherein the peripheral second portion consists of a zone of flexible material bonded with a rigid synthetic material of which the central first portion is obtained.

6. A device according to claim 1, wherein the peripheral second portion consists of a zone having a density smaller than the density of the central first portion, the central first portion and the peripheral second portion being made of a same material or of different materials.

7. A device according to claim 5, wherein the central first portion and the peripheral second portion are made of polyvinyl chloride (PVC).

8. A device according to claim 1, wherein the surfaces of the central first portion and of the peripheral second portion are concave, with the concave side facing outwards.

* * * * *